United States Patent [19]

Conn

[11] 4,060,846

[45] Nov. 29, 1977

[54] HIGH SECURITY LOCK

[75] Inventor: Michael L. Conn, San Jose, Calif.

[73] Assignee: United Technologies Corporation, Hartford, Conn.

[21] Appl. No.: 707,133

[22] Filed: July 20, 1976

[51] Int. Cl.[2] ..... E05B 49/02

[52] U.S. Cl. ..... 361/193; 361/201; 361/205; 70/278

[58] Field of Search ..... 317/134, 135 A, 136, 317/141 S; 70/276, 278; 307/40; 340/147 LP; 361/171, 172, 182, 191, 192, 193, 194, 195, 196, 201, 205

[56] References Cited

U.S. PATENT DOCUMENTS

| | | | |
|---|---|---|---|
| 3,608,342 | 9/1971 | Katz | 317/134 |
| 3,873,892 | 3/1975 | Dettling et al. | 317/134 |

*Primary Examiner*—Gerald Goldberg

*Attorney, Agent, or Firm*—Dominic J. Chiantera

[57] ABSTRACT

An improved high security locking apparatus is provided by combining an electromagnetic locking apparatus of the type which includes a lock portion and a removable key portion, the key portion providing a determined unlocking combination signal, the lock portion providing an immediate unlocking function in response to the presentation of the determined unlocking combination signal from the key portion while placed within a determined surface location of the lock portion, with an interlocked time delay circuit which provides silent, time delayed activation of the unlocking function in response to the simultaneous presence of the determined unlocking combination signal with the placement of the key portion within the determined surface location, and which inhibits the unlocking function for all other conditions.

4 Claims, 3 Drawing Figures

HIGH SECURITY LOCK

BACKGROUND OF THE INVENTION

1. Field of Invention

This invention relates to a high security lock, and more particularly to an improved high security lock with time delayed activation, with defeat and automatic reset characteristics.

2. Description of the Prior Art

The use of high security, low cost locking devices are currently in demand in the coin-operated machine industry for use in vending machines, washing machines, and the like. Due to the high rate of theft and pilferage in such machines the locks used to secure the coin deposit must be made as secure as possible, while the total cost of such a high security lock must be limited to that commensurate with the value of the money secured. More recent high security locking devices are of the electromagnetic combination type as opposed to the conventional, pick-proof, pin-tumbler locks. One such electromagnetic high security lock is disclosed by J. R. Dettling in U.S. Pat. No. 3,873,892, entitled HIGH SECURITY LOCK, and owned by the common assignee. The high security lock disclosed by Dettling is comprised of a lock portion and a separate, removable magnetic key portion. The lock portion is unlocked through activation of magnetically operable switches in response to the presentation of a predetermined unlocking combination code signal from the magnetic key. The security lock includes circuitry for defeating the unlocking function in the event of an improper placement of the magnetic key to the surface of the lock portion, however once proper placement of the key and entry of the determined unlocking combination code is made, the unlocking function is immediately activated. Admittedly, the requirements that the unlocking function may only be performed by presentation of the determined unlocking combination code by a magnetic key properly placed on a defined surface of the lock do provide a significant deterrant to unauthorized entry, however, the imaginative efforts of a thief are boundless. One significant limitation to the security of the lock is the immediate activation of the lock which aids unauthorized entry through a "searching combination" technique, i.e. successive key placement and combination code setting permutations. A proper key placement and combination code is signalled by the audible sounds provided by the electromotive unlocking device. Therefore, to further improve the security of the locking device, it is desirable to provide delayed activation of the lock to further reduce the probability of unauthorized unlocking of the device through a "searching combination" technique, while maintaining the low cost of the device.

SUMMARY OF THE INVENTION

One object of the present invention is to provide an improved high security locking apparatus having an interlocked, time delayed unlocking function. Another object of the present invention is to provide such an improved, high security locking apparatus at a minimum of added cost and complexity.

According to the present invention, an electromagnetic locking apparatus having a lock portion and a removable key portion, the key portion providing a determined unlocking combination signal, the lock portion being responsive to the placement of the key portion on a determined surface location of the lock portion, and having an electromotive device for providing the unlocking function in response to an unlock voltage signal presented through a switch contact arrangement provided by selective activation of a plurality of switches in response to the presentation of the determined unlocking combination signal from the key portion, the plurality of switches including at least one switch for providing a signal manifestation in response to the proximate placement of the key portion within the determined surface location of the lock portion, is further provided with an interlocked time delay circuit which includes a timing circuit, responsive to the unlock voltage signal and to the signal manifestation from the proximity switch, for providing, at the end of a determined time interval following presentation of the unlock voltage signal, a gate signal in response to the simultaneous presence of the unlock voltage signal and the signal manifestation during the determined time interval, the time delay circuit further including a switch circuit, interconnected between the switch contact arrangement provided by the plurality of switches and the electromotive device and selectively operable in a first state or a second state in response to the presence or absence of the gate signal from the timing circuit, the switch presenting the unlock voltage signal to the electromotive device when operated in the first state in response to the presence of a gate signal, the switch not presenting the unlock voltage signal to the electromotive device when operated in a second state in response to the absence of a gate signal.

The improved high security lock of the present invention provides a further degree of lock security by providing time delayed activation of the lock through a time delay circuit which is audibly silent. An intruding party attempting unauthorized entry by searching for the proper combination code will be unaware of the proper code entry since the unlocking occurs only after an interim time delay greater than that normally expected for an unlocking response, and no audible verification is provided. In addition the time delay circuit provides minimum complexity and added cost to the locking device.

Other objects, features and advantages of the present invention will become more apparent in the light of the following detailed description of the preferred embodiments thereof, as illustrated in the accompanying drawing.

DESCRIPTION OF THE PREFERRED EMBODIMENT

Figure 1:
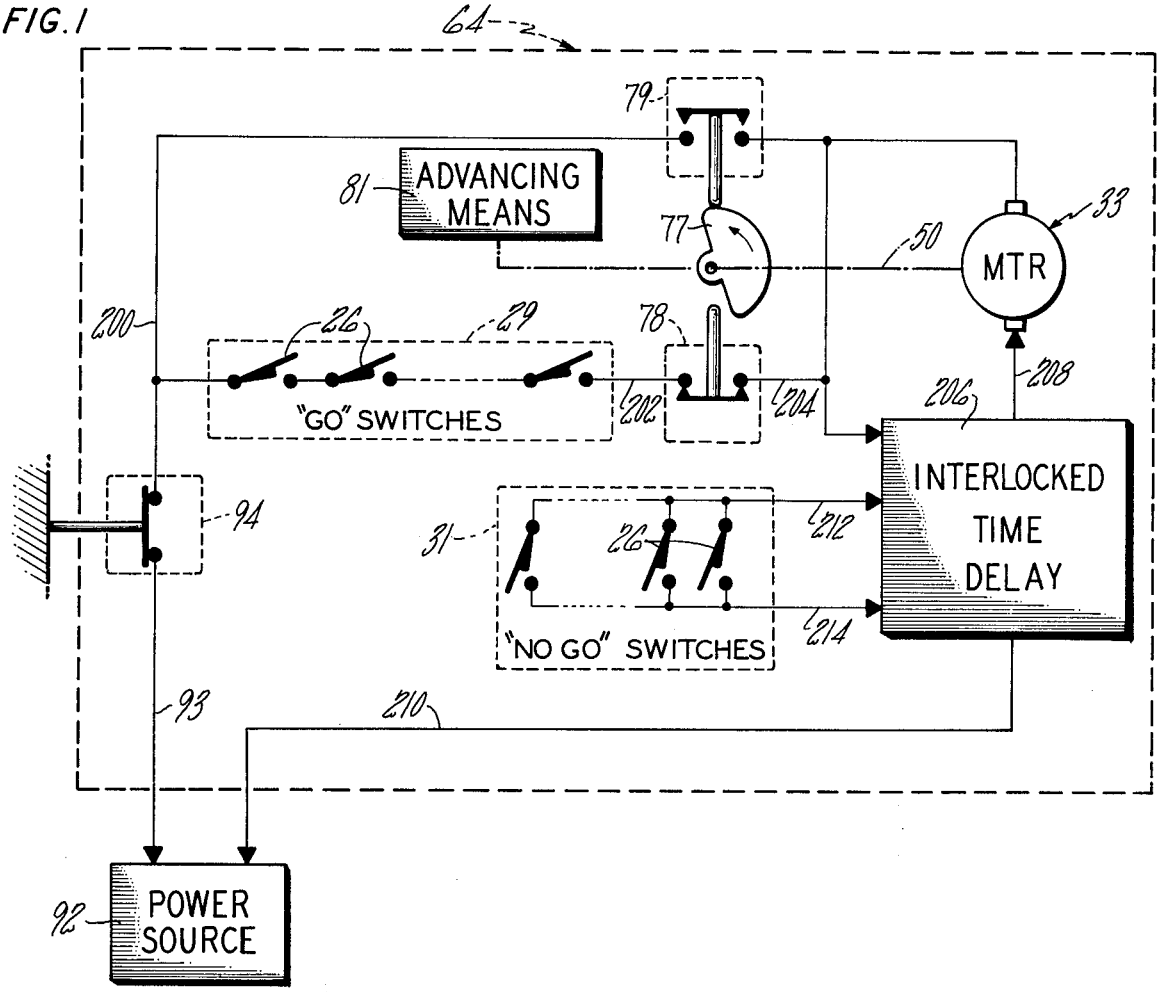
FIG. 1 is a partial system block diagram of an improved high security lock according to the present invention.

The interlock time delay of the present invention is intended for use in a high security lock of the type disclosed by J. R. Dettling in U.S. Pat. No. 3,873,892 entitled HIGH SECURITY LOCK and owned by the common assignee, and the subject matter disclosed therein is fully incorporated by reference into this application. The description of the common subject matter and elements of the high security lock disclosed by Dettling are made by specific reference to the Dettling patent figure numbers. The same reference characters used in the Dettling patent are used here for easy reference, while the reference characters of the present application begin with the number 200.

As disclosed in the hereinbefore referenced Dettling patent, a high security lock 21 includes a lock portion 22 and a removable key portion 23 (Dettling FIG. 1). In the exemplary embodiment shown therein, a lock portion 22 includes a plurality of magnetically actuated switches 26, such as reed switches, disposed in a preselected pattern along a determined inside surface of a removable drawer 64. The drawer 64 further includes an electromotive device 27 which provides the desired unlocking and locking functions in response to an unlock voltage signal provided by a source of voltage through a line 93, an interlock switch 94, and the plurality of switches 26 (Dettling FIGS. 3, 12) which as described in detail hereinafter, provide an electrically conductive path from the line 93 to the electromotive device 27 when activated in response to a predetermined combination signal from the key portion 23. The key portion 23 is removable from the lock portion 22 (Dettling FIG. 4) and includes a plurality of permanent magnets 28 disposed on rotatable elements 43, 47 (Dettling FIG. 6). The rotatable elements are relatively disposed to provide a combination setting function similar to that performed in a combination lock, such that proper positioning of the rotatable elements causes a spatial and magnetic gradient alignment of the magnets 28 with corresponding ones of the magnetic reed switches 26, activating the switches which in turn activate the electromotive device 27, as described in detail hereinafter.

As shown in FIG. 12 of Dettling, the plurality of magnetic reed switches 26 are divided into two circuits, a series circuit 29, wherein some number of the switches 26 have their switch contacts electrically connected in series, and a parallel circuit 31 where the contacts of the remaining switches are electrically connected in parallel. When activated by the magnetic gradient provided by the key portion 23 in response to a determined unlock combination signal, the contacts of the switches 26 comprising the series circuit 29 provide a conductive path from a voltage source 92 (presented through the interlock switch 94) to a limit switch 78. The limit switch 78 is operable in either an open or closed state, in response to the urging of a cam 77 mounted through a shaft 50 to the electromotive device 27, which may be a synchronous motor 33, and which drives the locking-/unlocking mechanism. A second limit switch 79 is similarly operable in an open or closed state in dependence on the position of the cam 77, and provides a shunt bypass of the series circuit 29 at a selected position of the cam 77. With the switch 78 closed, and the switch 79 open, the series circuit 29 is connected to one side of a primary winding 34 of the synchronous motor 33, the other end of which is connected to the voltage source 92. The parallel circuit 31 is connected on one end to the junction of the series circuit 29 and the position switch 78, and on the other end to one side of a second motor winding 36, oppositely phased to the winding 34, the other side of which is similarly connected to the voltage source 92. The portion of the switches 26 comprising the parallel circuit 31 are not responsive to the unlock combination signal provided by the key portion 23, but rather provide a defeat to the unlocking procedure in the event of tampering, or improper entry. Since the key portion 23 is removable from the lock portion 22, an essential initial step in a proper unlock procedure is proper placement of the key portion on a determined surface location of the lock portion; i.e. that surface portion of the drawer 64 on which the switches are mounted. To ensure that only the precise positioning of the key to the lock surface will initiate the unlocking procedure additional magnets may be positioned in a fixed array along the mating key surface, while those magnetic switches 26 comprising the parallel circuit 31 are similarly arrayed on the mating surface of the drawer 64. The switches may be made to activate in response to proper placement of the key, i.e. spatial alignment of the magnetic gradient provided by the fixed key magnets, or alternatively may be made to activate in response to an improper key placement. In this manner the switches of the parallel circuit perform as proximity switches, or sensors, and provide a signal manifestation of the proper key placement. Since the exact surface location is known only to authorized parties, an intruder in possession of a key and attempting entry through a searching combination technique, is further inhibited until he finds the correct key position. In FIG. 12 of Dettling, the switch contacts of the parallel circuit 31 are normally open. In the event of improper key placement, one or more switches activate to provide a closed path from the series circuit 29 to the motor winding 34. If the proper, determined unlock combination signal is then provided by the key, the voltage signal from the source 92 is simultaneously presented to both windings 34, 36. The windings are oppositely phased and the magnetic field created by each cancel, such that the motor cannot rotate.

The operation of opening and closing the security lock is described in detail at column 7, line 43 et seq. of the hereinbefore cited Dettling patent, and the unlocking operation is briefly summarized here to illustrate the improved lock security provided by the use of the interlocked time delay of the present invention. As stated hereinbefore, a proper initial placement of the key portion on the surface of the drawer 64 of the lock portion and entry of the proper, determined unlock combination signal by the setting of the key rotatable elements causes closure of the contacts of the switches 26 in the series circuit 29, providing electrical continuity from the source 92 to one side of the position switch 78. The position switch, which is closed for the cam 77 position shown, provides electrical continuity through the motor winding 34, causing the motor to rotate the shaft 50 and the cam 77 in a counterclockwise direction. The cam 77 rotates through slightly less than one-half of a full rotation, to a point at which the switch 78 is urged to the open position, opening the electrical path and causing the motor to stop. At this time both switches 78, 79 are open, the drawer 64 is unlocked, and the motor is unable to rotate. If at any time during the unlocking cycle any of the switch contacts of the switches 26 comprising the parallel circuit 31 are closed in response to a shifting of the magnetic key 23 location on the surface of the lock portion 22, the winding 36 is energized creating a magnetic field opposite to that provided by the winding 34, such that the two fields cancel and the motor stops, stopping the unlocking procedure. In this case the key portion 23 must be repositioned to the proper position to allow the corresponding switches of the parallel circuit 31 to open and de-energize the winding 36.

As may be seen, the opening cycle of the Dettling security lock permits immediate initialization of the unlocking cycle, i.e. energizing the motor, upon proper location of the key and entry of the determined unlocking combination code. No delay is provided. Anyone attempting to break into the lock portion through a searching combination technique is immediately notified of the proper code selection by the audible sound provided by the operation of the synchronous motor in performing the unlocking function, thereby greatly facilitating unauthorized entry and reducing the security of the lock.

Figure 2:
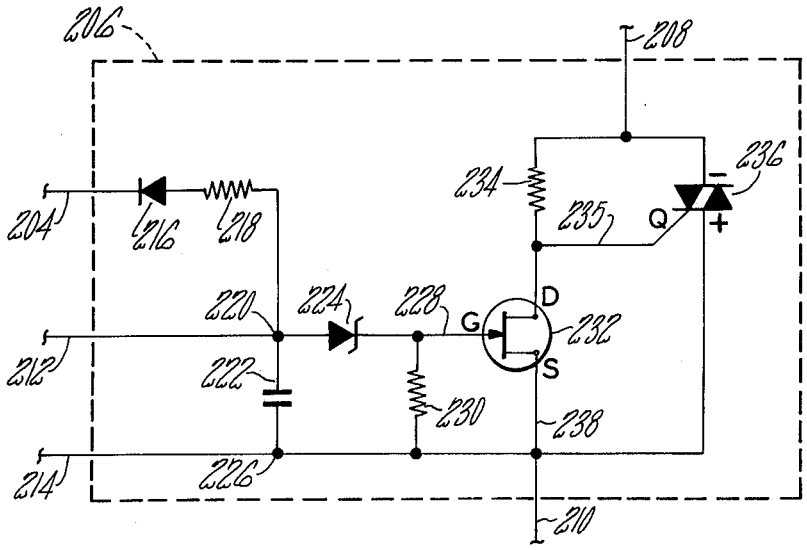
FIG. 2 is a schematic illustration of an interlocked time delay circuit as used in the embodiment of FIG. 1.
Figure 3:
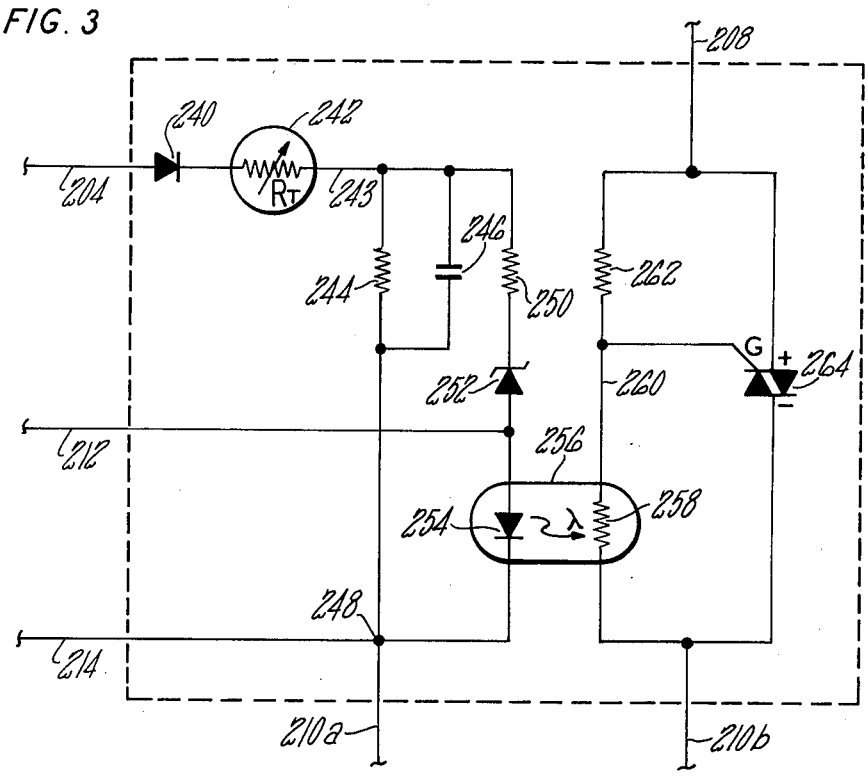
FIG. 3 is a schematic illustration of an alternative embodiment of an interlocked time delay circuit used in the embodiment of FIG. 1.

Referring now to FIG. 1, in an improved high security lock including an interlocked time delay network according to the present invention, the drawer 64 included within the lock portion 22 receives electrical power from the source 92, which may be either AC or DC power depending on the specific application and characteristics of the motor 33 used. In FIGS. 2, 3 it is assumed that the electrical power provided is AC, 120 VRMS, 60 Hz. The AC voltage is presented through the line 93, interlock switch 94, and a line 200 to one side of the series circuit 29, and to one side of the limit switch 79. The other side of the series circuit 29 is connected through a line 202 to one side of the limit switch 78, the other side of which is connected through a line 204 to one side of the motor 33, and to one input of an interlocked time delay circuit 206. The time delay 206 is connected through a line 208 to the other side of the motor 33 and through a line 210 to the low potential input of the power source 92. The parallel circuit 31 of switches 26 is presented through the lines 212, 214 to second and third inputs of the time delay 206. As may be seen by a comparison of FIG. 1 of the present application and FIG. 12 of the Dettling patent, the series circuit 29 and the parallel circuit 31 are now connected to the interlock time delay 206 which is connected between the motor 33 and the source 92, and which prevents the switches from directly energizing the motor 33. As described in detail hereinafter, the time delay 206 provides a time delayed activation of the motor 33, and hence the unlocking function, in the absence of any closure of the switch contacts of the parallel circuit 31, and after the appearance of an unlock voltage signal on the line 204 (the 120 VRMS, 60 Hz AC signal as presented through the circuit 29 represents both the command and the driving signal to the motor to provide the unlocking function) as provided from the source 92 through the series circuit 29 whose contacts are closed in response to the entry of the determined unlock combination signal from the key 23.

Referring now to FIG. 2, in an illustrative embodiment of an interlock time delay 206, the unlock voltage signal on the line 204 is presented to the cathode of a steering diode 216 of a type well known in the art, such as a 1N3070 silicon diode. The diode 216 provides negative, half-wave rectification of the AC signal presented on the line 204 to provide a DC average signal through a resistor 218 to a junction 220. The sensed polarity of the diode 216 is discretionary, and may be reversed to provide positive half-wave rectification so long as the remaining components of the time delay 206 are suitably polarized to accommodate the positive rectification. The junction 220 is connected to one side of the parallel circuit 31 through the line 212, to one side of a capacitor 222, and to the anode of a zener diode 224. The other side of the capacitor 222 is connected through a junction 226 to the lines 210, 214. The capacitor 222 may be one of a number of well known types in the art which provide capacitance values in the range of one to ten microfarads with a minimum insulation resistance of one megohm per microfarad. The zener diode 224, also of the type well known in the art such as a 1N4116, 24 volt 5 percent zener diode, is connected through a line 228 to a resistor 230, the other side of which is connected to the line 210, and to the gate of a field effect transistor (FET) 232, such as a 2N5639 depletion mode FET. The drain terminal of the FET 232 is connected through a resistor 234 to the line 208, and to the gate of a voltage controlled switch 236, such as an L200E3 triac, an SCR, or a transistor of suitable power and voltage ratings commensurate with the characteristics of the power source 92. The switch 236 has its negative terminal (cathode) connected to the line 208 and its positive terminal (anode) connected to the line 210.

In the operation of the time delay 206, the closure of all of the switch contacts in the series circuit 29 in response to the presentation of the determined unlock combination signal from the key 23 provides electrical continuity from the power source 92 through the closed limit switch 78 to the line 204. The unlock voltage signal on the line 204 is rectified by the diode 216 and applied through the resistor 218 and junction 220. The capacitor 222 charges to the average value of the half-wave rectified signal at an approximate time constant rate of $T_1 = R_{218} \times C_{222}$, to provide a time dependent amplitude voltage signal at the junction 220 which increases from zero to a final steady state value approximately equal to the average value of the rectified signal. For typical values of $R_{218} = 1.2$ megohms and $C_{222} = 6.8$ microfarads, the approximate time constant value is equal to 8.16 seconds. Since the average value of a half sine wave is equal to $1/\pi$, the average rectified DC value of the 120 VRMS signal is approximately 54 volts DC. For a zener diode 224 having a nominal value of 24 volts, the capacitor 222, with a charging time constant equal to 8.16 seconds, charges to a 24 volt level in approximately 4.8 seconds causing the zener diode 224 to break down and provide a negative bias current signal through the resistor 230 to the return side of the source 92, developing a negative voltage signal at the gate of the FET 232. The FET 232 which is normally conducting in the absence of any voltage signal from the zener diode 224, i.e., the gate to source potential is approximately zero, turns off at the appearance of the negative voltage signal at the gate. When the FET is conducting, the anode-to-gate potential of the triac 236 is equal to the FET drain-to-source potential, or approximately zero, and the triac is nonconducting. The source-to-drain current through the FET is limited by the value of the resistor 234 to a fraction of the motor 33 operating current, such that the motor is unable to rotate during the capacitor 222 charging time. As the FET turns off the anode-to-gate potential of the triac 236 is no longer held to approximately zero, such that gate current flows through the resistor 234 creating a gate voltage sufficient to turn on the triac. When on, the triac provides a conductive path between the line 210 and the line 208, and completes the conductive path from the power source 92 to the motor 33. The motor 33 is energized and rotates the shaft 50 to unlock the drawer 64 through the mechanical procedure disclosed in the Dettling patent.

As shown in FIG. 2, the switch contacts of the parallel circuit 31 shunt the capacitor 222. If the key 23 is offset from the determined surface location of the lock, one or more of the contacts will close shorting the capacitor and completely inhibiting the unlocking function. Similarly, if the key is repositioned after proper placement of the key and entry of the determined combination signal, but prior to turn on of the triac, contact closure causes the capacitor to discharge through the closed contacts and remain inhibited until the correction is made.

When the drawer 64 is removed, after unlocking, the interlock switch 94 (FIG. 1) opens and removes the voltage signal from the power source 92. Similarly, the switch contacts of the series circuit 29 are open due to the removal of the key 23 from the surface of the lock 22. To relock the drawer 64, the advancing means 81 is used to manually urge the cam 77 to a position wherein the limit switch 79 closes while the limit switch 78 remains open. The re-insertion of the drawer 64 closes the switch 94, and the voltage signal is applied through the line 200 and closed limit switch 79 to the motor 33. With power off while the drawer was removed the capacitor 222 ideally maintains its charge, such that re-insertion of the drawer results in immediate motor operation (the FET switch 232 is biased off and the triac 236 is gated on). In the event that some leakage does occur across the capacitor 222, some time delay will result before the capacitor 222 again charges to a level exceeding the threshold value of the zener diode 224, turning on the triac 236, as described hereinbefore, and activating the motor. With the motor 33 energized the shaft is rotated counterclockwise until the drawer is locked and the cam 77 makes contact with the limit switch 79, causing the switch to open, stopping the motor, and stopping the cam 77 in the approximate position shown in FIG. 1.

An alternative embodiment of the interlock time delay 206 is shown in FIG. 3, where the time delay is provided by a thermally dependent device, such as a thermistor, and activation of the motor 33 is provided through an isolation coupling circuit, such as an optical coupler. This embodiment may be preferred in situations where it is desirable to achieve longer time delays than are capable of practical achievement with the RC time constant network of FIG. 2, and where isolation of signal ground from motor return ground is desired to reduce noise or interference of the time delay circuit by the energized motor.

Referring now to FIG. 3, the voltage signal on the line 204 is presented through a steering diode 240 similar to the diode 216 in FIG. 1, which provides positive half-wave rectification of the signal on the line 204. The cathode of the diode 240 is connected to one side of a thermistor 242, the other side of which is connected through a line 243 to a parallel combination of a resistor 244 and a capacitor 246. The other side of the parallel combination is connected through a junction 248 to the line 214, and to a line $210_a$ which represents a signal return path portion of the line 210 of FIG. 1. The thermistor 242 is also connected through the line 243 and a resistor 250 to a zener diode 252, similar to the zener diode 224 of FIG. 2. The anode side of the diode is connected to the parallel circuit 31 through the line 212, and to the light emitting diode (LED) portion 254 of an optically coupled isolator 256, the other side of which is connected to the junction 248. One side of the light sensitive resistor portion 258 of the optically coupled isolator 256 is connected through a line 260 to a resistor 262 and to the gate of a voltage control switch 264, similar to the switch 236 of FIG. 2. The other side of the light sensitive resistor 258 is connected through a line $210_b$, which represents the motor return signal path portion of the line 210 of FIG. 1.

In operation, the voltage signal applied to the line 204 is half-wave rectified and applied through the thermistor 242 to the parallel RC combination of R244 and C246. The thermistor 242 has a negative temperature coefficient, such that the resistance of the thermistor decreases with self-heating. The negative temperature coefficient of the thermistor 242 in combination with the parallel RC combination of resistor 244 and C246 causes a slow buildup of the voltage signal on the line 243. Selection of the time constant value for the RC combination and the temperature coefficient of the thermistor 242 allows for a wide variation in the selection of the time delay provided for buildup of the voltage signal on the line 243 to a value exceeding the reference threshold value of the zener 252. When the voltage signal on the line 243 exceeds the threshold level of the zener 252, current flows through the LED 254 which emits an optical signal to the light sensitive resistor 258. The light sensitive resistor 258 reduces its resistance in response to the LED signal causing current to flow through the resistor 262 and develop sufficient voltage to turn on triac 264, providing electrical continuity between the lines 208 and the line $210_b$. The motor 33 is provided with an electrically conductive path to the source 92, and the motor is energized. As with the embodiment of FIG. 2, if the magnetic key element 23 is not placed in the correct surface location of the lock portion 22, or if the switch is repositioned or slips in any way during the combination setting sequence, such that the magnetic gradient between the magnets in the key and the magnetic switches in the parallel circuit 31 is disturbed, a closure of one or more of the switches of the parallel circuit 31 occurs, shunting the LED portion 254 and providing a complete inhibit through activation of the motor 33.

The improved high security lock of the present invention, provides a higher level lock integrity by providing silent, delayed activation of the unlocking device thereby reducing the probability of unauthorized entry through the use of a searching combination technique. The silent, delayed activation precludes audible verification of a successful unlock combination permutation. The improved lock integrity resulting from the delayed activation is provided with a minimum amount of added complexity and cost. In addition, the time delay function is susceptible to different embodiments and to a range of delay time values.

The interlock feature of the time delay provides a defeat of the unlocking function by inhibiting the delay. The delay inhibit is itself silent, as opposed to the audible noise provided by the motor in response to the cancelling magnetic fields which provides the defeat function, as in the hereinbefore referenced Dettling patent. Similarly, although the invention has been shown and described with respect to an illustrative embodiment thereof, it should be understood by those skilled in the art that the foregoing and various other changes, omissions and additions in the form and detail thereof may be made therein without departing from the spirit and scope of this invention.

Having thus described typical embodiments of my invention, that which I claim as new and desire to secure by Letters Patent is:

1. An improved electromagnetic locking apparatus of the type which includes a lock portion and a removable key portion, the key portion providing a determined unlocking combination signal, the lock portion having an electromotive device for providing a desired unlocking function in response to an unlock voltage signal presented through a switch contact arrangement provided by selective activation of a plurality of switches in response to the placement of the key portion on a determined surface location of the lock portion coincident with presentation of the determined unlocking combination signal, the plurality of switches including at least one switch for providing a signal manifestation in response to the proximate placement of the key portion within the determined surface location of the lock portion, wherein the improvement comprises:

time delay means, responsive to the unlock voltage signal and to the signal manifestation, for providing, at the end of a determined time interval following presentation of the unlock voltage signal, a gate signal in response to the simultaneous presence of the unlock voltage signal and the signal manifestation during the determined time interval; and switch means, interconnected between the switch contact arrangement provided by the plurality of switches and the electromotive device, and selectively operable in a first state or a second state in response to the presence or absence of the gate signal from said timing means, said switch means presenting the unlock voltage signal to the electromotive device when operated in the first state in response to the presence of a gate signal, said switch means not presenting the unlock voltage signal to the electromotive device when operated in a second state in response to the absence of a gate signal.

2. The improved electromagnetic locking apparatus of claim 1, wherein the time delay means comprises:

timing means, for providing a timing signal in response to the presentation of the unlock voltage signal during the presence of the signal manifestation, said timing signal having a time varying amplitude which increases at a determined amplitude rate of change with time from a substantially zero amplitude, coincident with the presentation of the unlock voltage signal, to a final steady state amplitude value, in dependence on a determined time constant value and on the continuous and simultaneous presence of the unlock voltage signal and the signal manifestation, said timing means not providing said timing signal in the absence of either the unlock voltage signal or the signal manifestation, said timing means resetting said timing signal to a substantially zero amplitude in the absence of the continuous presence of the signal manifestation; and amplitude detection means, responsive to said timing signal, for providing the gate signal in response to a determined amplitude value of said timing signal, said determined amplitude value being greater than zero and less than said timing signal steady state amplitude value, said determined amplitude value being substantially equal to the product of said timing signal amplitude rate of change and the determined time interval value.

3. In an electromagnetic locking apparatus of the type which includes a lock portion and a removable key portion, the key portion providing a determined unlocking combination signal, the lock portion having an electromotive device for providing a desired unlocking function in response to an unlock voltage signal presented through a switch contact arrangement provided by selective activation of a plurality of switches in response to the placement of the key portion on a determined surface location of the lock portion coincident with presentation of the determined unlocking combination signal, the plurality of switches including at least one switch for providing a signal manifestation in response to the proximate placement of the key portion within the determined surface location of the lock portion, an interlocked time delay comprising:

time delay means, responsive to the unlock voltage signal and to the signal manifestation, for providing, at the end of a determined time interval following presentation of the unlock voltage signal, a gate signal in response to the simultaneous presence of the unlock voltage signal and the signal manifestation during the determined time interval; and switch means, interconnected between the switch contact arrangement provided by the plurality of switches and the electromotive device, and selectively operable in a first state or a second state in response to the presence or absence of the gate signal from said timing means, said switch means presenting the unlock voltage signal to the electromotive device when operated in the first state in response to the presence of a gate signal, said switch means not presenting the unlock voltage signal to the electromotive device when operated in a second state in response to the absence of a gate signal.

4. The interlocked time delay of claim 3, wherein the time delay means comprises:

timing means, for providing a timing signal in response to the presentation of the unlock voltage signal during the presence of the signal manifestation, said timing signal having a time varying amplitude which increases at a determined amplitude rate of change with time from a substantially zero amplitude, coincident with the presentation of the unlock voltage signal, to a final steady state amplitude value, in dependence on a determined time constant value and on the continuous and simultaneous presence of the unlock voltage signal and the signal manifestation, said timing means not providing said timing signal in the absence of either the unlock voltage signal or the signal manifestation, said timing means resetting said timing signal to a substantially zero amplitude in the absence of the continuous presence of the signal manifestation; and amplitude detection means, responsive to said timing signal, for providing the gate signal in response to a determined amplitude value of said timing signal, said determined amplitude value being greater than zero and less than said timing signal steady state amplitude value, said determined amplitude value being substantially equal to the product of said timing signal amplitude rate of change and the determined time interval value.

* * * * *